US005109662A

United States Patent [19]

Inger

[11] Patent Number: 5,109,662

[45] Date of Patent: May 5, 1992

[54] OPERATING METHOD AND APPARATUS FOR THE AUTOMATED REMOVAL OF YARN REMNANTS FROM WINDING TUBES BY AN AUTOMATED MAINTENANCE AND SERVICING DEVICE TRAVELING ALONG A TEXTILE YARN PROCESSING MACHINE

[75] Inventor: Siegfried Inger, Tönisvorst, Fed. Rep. of Germany

[73] Assignee: Palitex Project Company GmbH, Krefeld, Fed. Rep. of Germany

[21] Appl. No.: 784,146

[22] Filed: Oct. 30, 1991

Related U.S. Application Data

[63] Continuation of Ser. No. 550,119, Jul. 9, 1990, abandoned.

[30] Foreign Application Priority Data

Jul. 24, 1989 [EP] European Pat. Off. ..... 89113546.9

[51] Int. Cl.[5] ..... D01H 9/10; D01H 11/00

[52] U.S. Cl. ..... 57/305; 57/58.49; 57/270; 57/275; 57/304; 242/35.5 A

[58] Field of Search ..... 242/35.5 A, 35.5 R; 28/295; 57/270-271, 275, 281, 304, 305, 58.49

[56] References Cited

U.S. PATENT DOCUMENTS

| | | | |
|---|---|---|---|
| 3,370,412 | 2/1968 | Franzen et al. | 57/270 |
| 4,127,983 | 12/1978 | Munker | 57/305 X |
| 4,137,700 | 2/1979 | Münker | 57/305 X |
| 4,722,177 | 2/1988 | Bonnefoi et al. | 242/35.5 A X |
| 4,845,815 | 7/1989 | Nelson et al. | 28/295 |
| 4,848,076 | 7/1989 | Ueda et al. | 57/281 |
| 4,899,530 | 2/1990 | Morrison | 57/275 X |
| 4,899,532 | 2/1990 | Sanno | 28/295 X |
| 4,928,476 | 3/1990 | Otoshima et al. | 242/35.5 A |
| 4,979,360 | 12/1990 | Kallmann et al. | 57/270 X |

*Primary Examiner*—Daniel P. Stodola
*Assistant Examiner*—William Stryjewski
*Attorney, Agent, or Firm*—Bell, Seltzer, Park & Gibson

[57] ABSTRACT

In yarn processing stations, in which two yarns are withdrawn from feed yarn packages inserted on a package adapter, the problem arises that a residual yarn wind is left on the tube of a feed yarn package. To remove this residual yarn wind, the maintenance and servicing device of the present invention is provided witha rotatable, upward and downward movable gripper for the removal of the package adapter from the yarn processing station, at least one rotatably supported mandrel to receive the package adapter, a rotatably supported, upward and downward movable cutting device for severing a residual yarn wind left on a feed yarn tube, and a rotatably supported suction device for the removal of the cut residual yarn, so as to be able to perform, according to the method of the present invention, the cleaning of feed yarn tubes still carrying yarn remnants directly after their removal from the yarn processing station.

6 Claims, 5 Drawing Sheets

OPERATING METHOD AND APPARATUS FOR THE AUTOMATED REMOVAL OF YARN REMNANTS FROM WINDING TUBES BY AN AUTOMATED MAINTENANCE AND SERVICING DEVICE TRAVELING ALONG A TEXTILE YARN PROCESSING MACHINE

This application is a continuation of copending application Ser. No. 07/550,119 filed on Jul. 9, 1990, now abandoned.

FIELD, BACKGROUND AND OBJECT OF THE INVENTION

In yarn processing stations, in which in the normal practice yarns are withdrawn from two superposed feed yarn packages creeled on a package or transport a residual wind is left on one of the two feed yarn packages. The problem arises likewise with the use of assembly-wound packages.

Yarns are also twisted by the two-for-one twisting method from assembly-wound feed yarn packages. The two yarn strands participating in the twisted yarns are previously doubled (plied) on an assembly winder and wound on one package.

In the normal case, one can presume that the assembly-wound feed yarn packages unwind completely and that thus no yarn remnants are left on the assembly winding tube. Practice, however, shows that some residual yarn is occasionally left on the tube shortly before an assembly-wound package is fully unwound. The reason therefore is to be found in the initial wind on an assembly winder, where the initial yarn layers often engage with one another. The consequence is a yarn break on the two-for-one twisting spindle and thus a yarn break on the assembly winding tube.

In the further handling or transportation of the package or transport adapter, which carries a winding tube not yet fully unwound, such yarn remnants can lead to problems or breakdowns, under circumstances, due to the loose yarn ends.

Until now, the tubes have been cleaned, in particular from yarn remnants, in installations not integrated in the machine. To this end, it has been necessary to handle winding tubes still carrying some residual yarn several times. It has further been necessary to cover, in part, long distances. Only after that is a tube with a yarn remnant available at a tube cleaning device.

In accordance with the present invention, an improved maintenance device is provided for a textile yarn processing machine having a plurality of spindle assemblies mounted in side-by-side relationship longitudinally of the machine and each including a package and transport adapter carrying at least one tube and supply package of yarn wound thereon. The improved maintenance device includes a housing mounted for movement longitudinally along the machine to each of the spindle assemblies. The maintenance device has gripper means mounted in the housing for upward, downward and pivoting horizontal movement to move out of the housing and grip the package and transport adapter when the yarn is substantially used therefrom and move the package and transport adapter into the housing, and mandrel means for receiving and supporting the package and transport adapter moved into the housing by the gripper means. Driven cutting means are mounted in the housing for upward, downward and pivoting horizontal movement to move into engagement with and along the surface of the yarn supply package tube on the package and transport adapter on the mandrel to cut any residual yarn windings thereon. A suction means for pivoting horizontal movement to be positioned to remove the cut windings.

The object is to realize the concept of removing residual yarn winds from a winding tube or unwound tube of a feed yarn package, which is creeled on a package adapter, already inside the maintenance and servicing device, directly after the removal of an unwound unit comprising a package adapted and at least one winding tube carrying some residual yarn. In this manner, it will no longer be necessary to further handle tubes with a residual yarn wind on subsequent processing stations. The tubes are directly cleaned by the maintenance and servicing device, so that the tube transport system receives a cleaned tube, which enters smoothly into the cycle of package transportation.

Preferred solutions are dealt with in the subclaims.

BRIEF DESCRIPTION OF THE DRAWINGS

The invention will be described below in greater detail with reference to the drawing, in which.

DETAILED DESCRIPTION OF PREFERRED EMBODIMENT OF THE INVENTION

Figure 1:
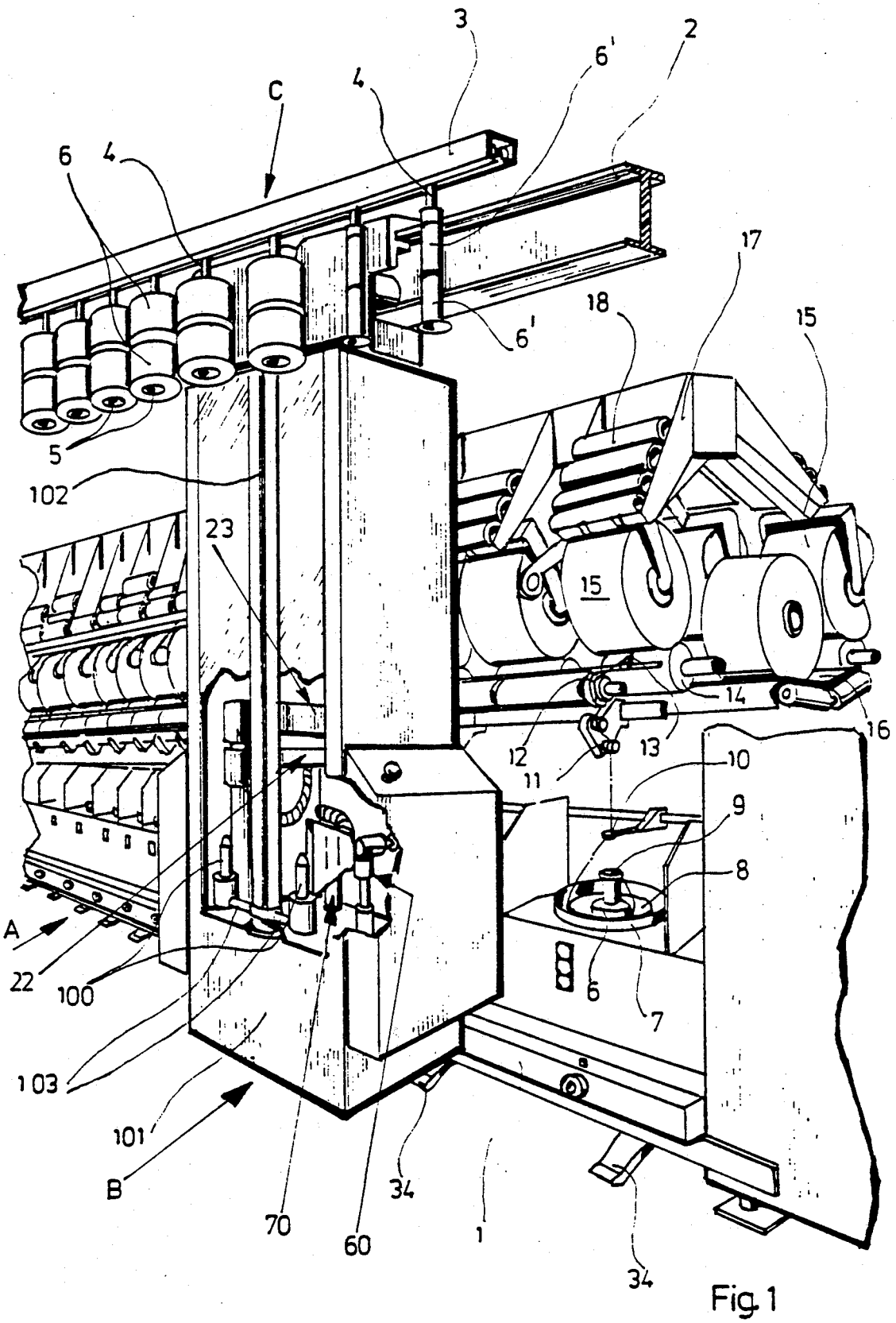
FIG. 1 is a perspective view of a portion of a two-for-one twister with an automatic main device traveling along this machine.

FIG. 1 shows a portion of a two-for-one twister A, an automatic maintenance device B traveling along the two-for-one twister on lower and upper rails 1 and 2, and an overhead conveyor C.

The overhead conveyor C comprises an upper rail 3, along which a conveyor chain or belt extends with evenly spaced-apart, downward directed suspension holders 4 attached thereto for accommodating package adapters or package transport adapters 5. The suspension holders 4 and the package adapters 5 are constructed in known manner, so that during a first upward movement of the package adapter 5, the latter is grasped and held by the suspension holder 4, and released therefrom during a second upward movement and subsequent lowering relative to the suspension holder 4. FIG. 1 shows in the region of the upper rail 3, on the left side, six package adapters 5, each loaded with two fully cross-wound packages 6, which are to be delivered by the automatic maintenance device B to the individual twisting positions of the two-for-one twister A, and on the right side, two package adapters 5, each holding two empty tubes 6', which were individually removed by the automatic maintenance device B from the twisting positions of the two-for-one twister A and delivered to a suspension holder 4. These tubes 6' are transported together with the package transport adapters 5 by means of the overhead conveyor C to an external loading station, where the adapters 5 can again receive fully wound yarn packages or feed yarn packages 6. The feed yarn packages may also be assembly-wound packages.

The two-for-one twister A comprises several working or twisting positions with the known standard elements, such as a spindle (not shown) in the lower portion, balloon limiter 7, protective pot 8, yarn inlet end 9, balloon yarn guide 10, deflecting elements 11 for controlling the yarn winding tension, overfeed element 12, traversing yarn guide 13, and a cross-wound package of the twisted yarn or takeup package 15, which is driven by a friction roll 14. In the center of the machine, a conveyor belt 16 extends in the upper region between the two parallel, longitudinal sides of the machine for the removal of fully wound twister packages 15. Located above each cross-wound twister package or takeup package 15 driven by friction roll 14 is a magazine 17 for empty takeup tubes 18.

Shown inside the protective pot 8 is an upper, only partially cross-wound package or feed yarn package 6 of a pair of packages inserted into the twisting position. From the feed yarn packages, the yarns are withdrawn upward and guided through the yarn inlet end 9 into the lower spindle portion to a yarn storage disk, whence the two combined yarns advance to balloon yarn guide 10 while forming a yarn balloon, and subsequently, after passing deflection rolls 11 and overfeed roll 12, onto a takeup package which is driven by a friction roll 14.

The automatic maintenance device B routinely travels in front of the two-for-one twister A or its individual twisting positions. FIG. 1 schematically illustrates portions of the various handling elements of the automat B, which serve to replace package adapters 5 loaded with empty winding tubes 6, (unwound unit) with package adapters 5 carrying fully cross-wound packages 6 (or also assembly-wound packages) (feed yarn unit), and to handle or secure the yarn ends of the empty or almost unwound tubes 6'. These elements are primarily two mandrels 100 for the feed yarn and unwound units, which are adapted to rotate about a vertical axis and to move upward and downward in vertical direction, as well as gripped and suction devices 22 and 23, respectively.

The automatic maintenance device comprises a cabinet-shaped housing 101, whose front wall is .00 provided with a guide slot 102 for a rotatable cross arm 103, which carries a mandrel 100.

Inside its housing 101, the automatic maintenance device B further accommodates a cutting device 60 for separating a residual yarn wind left on a tube 6' along a surface line, as well as a suction device 70 for removing the residual yarn wind cut by the cutting device 60.

The following description will refer to both the constructional details and the operating methods or functions of the individual elements of the present invention.

Figure 2:
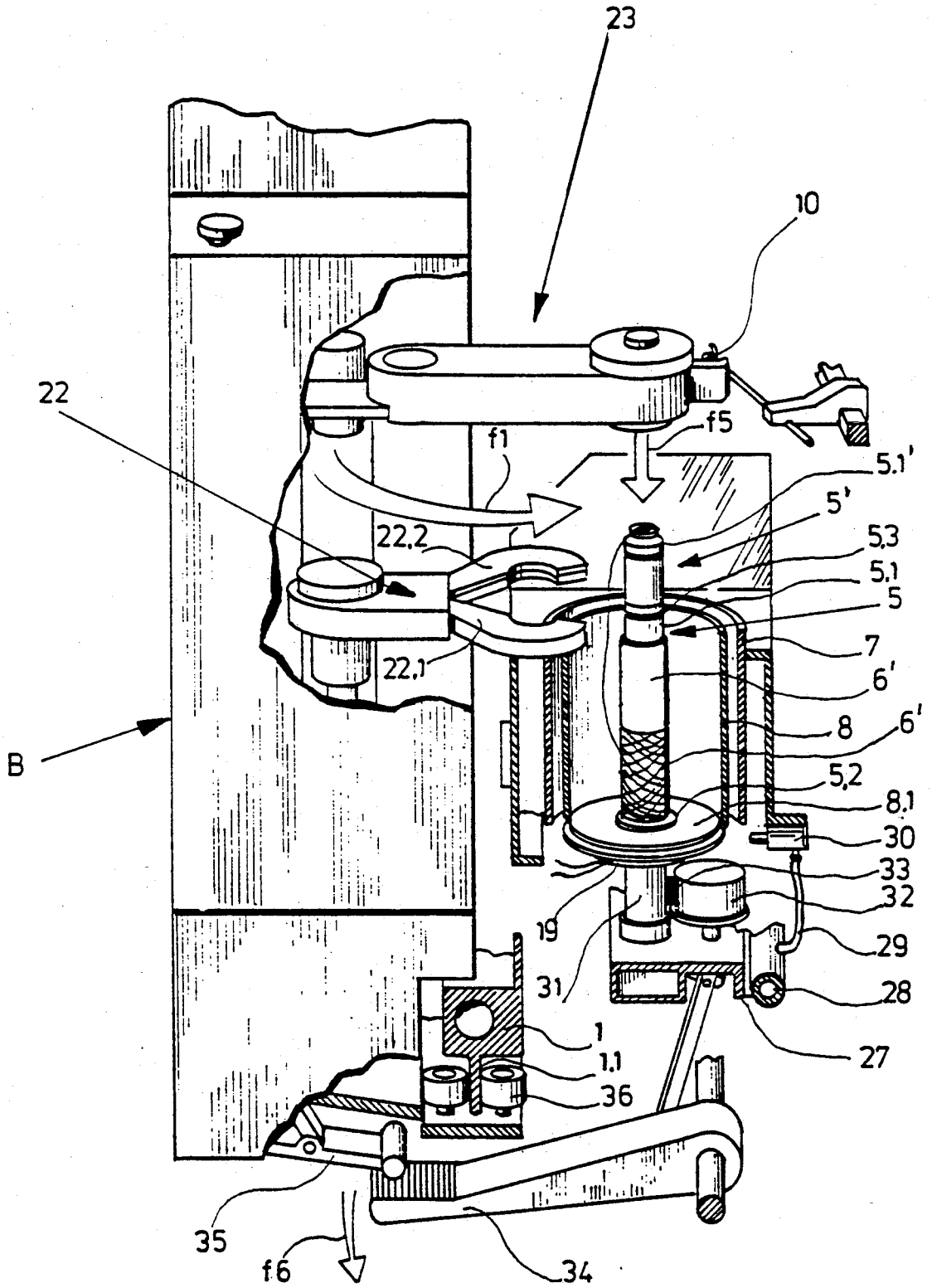
FIG. 2 is a partially sectional and partially perspective view of a two-for-one twisting spindle with an automatic maintenance device and its associated servicing and handling elements.

FIG. 2 shows in addition the bottom 8.1 of the protective pot of a two-for-one twisting spindle, as well as a standard yarn storage disk 19. The package adapter 5, which, as described above, is simultaneously a transport adapter, comprises a cylindrical portion 5.1, which is provided with a carrying flange 5.2 at its lower end, preferably with an annular groove 5.3 in the region of its upper end. A gripper 22 of the automatic maintenance device rotate in horizontal direction (arrow f1), and which is provided with two arms 22.1 and 22.2, serves to remove an unwound unit from the two-for-one twisting spindle. The ends of the two gripper arms 22.1 and 22.2 are able to tightly embrace the package adapter 5, which is inserted into the spindle pot 8, on its outer circumference, preferably however, in the region of its annular groove 5.3, thereby automatically clamping and securing at the same time the yarn end, which advances from the lower tube 6' not yet fully unwound, and enters into the hollow shaft of the package adapter. When removing a package adapter 5 from the protective pot 8 by the upward movement of gripper 22, it is necessary to see to it that the yarn end can be pulled out unobstructed from the hollow shaft of the spindle by the automatic opening of a yarn brake, which is arranged in known manner inside the hollow shaft of the two-for-one twisting spindle.

Figure 3:
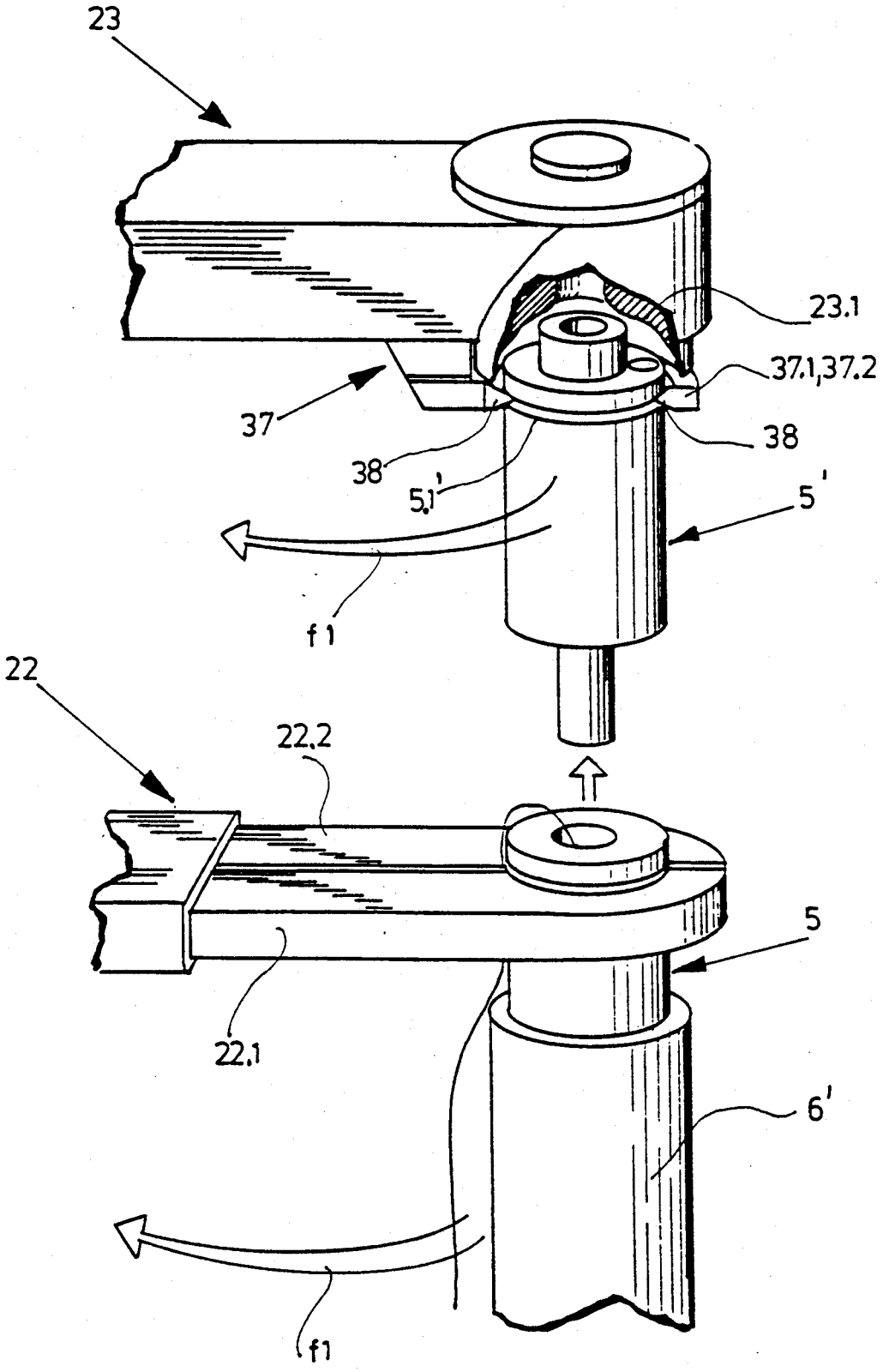
FIG. 3 is a schematic, perspective view of details of a lower gripper and an upper gripper likewise equipped with a suction device.

As is shown in FIGS. 2 and 3, the description proceeds from a bipartite package adapter. The lower portion of the adapter is a transport means for the fully wound packages or unwound tubes. In this form, the adapter is also a part of a package transport system superposed on the two-for-one twister. In the two-for-one twisting spindle, i.e. inside its protective pot, such lower adapter portions 5 serve at the same time to center the packages on the hub of the protective pot.

Inserted on this lower adapter portion 5 is a head piece or upper adapter portion 5' comprising a hollow shaft, which serves in known manner to produce different unwinding conditions of the yarn on a two-for-one twisting spindle. For example, thee upper adapter portion 5' may be a lubricating device of a known type, which forms a yarn inlet head serves to moisten a yarn passing therethrough with finishing agent.

FIG. 2 is a cross sectional view of a portion of the two-for-one twister, comprising a machine frame 27, a compressed-air line 28 with a connection 29 leading to a two-for-one twisting spindle and to a nozzle 30 for a pneumatic threadup of the yarn, and a spindle whorl 31 with a belt pressure roll 32 for pressing a tangential belt 33 against the spindle whorl 31. A foot pedal 34 associated to each individual spindle serves to actuate a spindle brake not shown, and to actuate likewise the compressed-air nozzle 30, so as to build up in known manner a suction air current in the hollow spindle shaft for the purpose of threading the yarn through the spindle.

FIG. 2 also shows portions of the automatic maintenance device B patrolling in front of the two-for-one twister on rails 1 and 2. These portions include detail views of the servicing and handling elements relevant for the present invention and/or the further description, such as the gripper 22 and suction device 23, as well as an actuation lever 35, which, when being depressed in direction of arrow f6 at a given moment, allows to actuate the pedal 34 for a shutdown of the individual spindles. FIG. 2 illustrates shortly above the pedal 34 two track rolls 36 of the automatic maintenance device B, which are guided along a surface 1.1 of the lower rail 1.

The suction device 23 as well as the gripper 22 are adapted to rotate in direction of arrow f1 and to vertically move upward and downward in direction of arrow f5.

As to FIG. 2, mention should be made that, once the suction device 23 is swung into the region of the spindle axis, the balloon yarn guide 10 is moved out of its position coaxial with the spindle.

FIG. 3 illustrates the gripper 22 as it grasps with its two arms 22.1 and 22.2 the lower adapter portion 5, thereby clamping simultaneously the yarn end extending to the tube 6' still holding a residual yarn wind.

The upper adapter portion 6' is held in position by an upper gripper 37, which is arranged on the suction device 23 and has two arms 37.1 and 37.2 rotatable in horizontal direction. While the two arms 22.1 and 22.2 of the lower gripper 22 are in a position to come to lie with their entire inner circumference against the outer circumference of the lower adapter portion 5 or annular groove 5.3 respectively, so that a yarn end is clamped irrespective of its position on the circumference relative to the lower adapter portion, the arms 37.1 and 37.2 of the upper gripper 37 are provided with inward directed projections or noses 38, which engage in point contact with an annular groove 5.1' of the upper adapter portion or yarn inlet head 5', so as to be able to raise the upper adapter portion 5' without clamping a yarn guided along the outside of the upper adapter portion 5'.

Integrated into the lower gripper 22 or respectively its arms 22.1 and 22.2 as well as in suction device 23 are air channels, which are not subject matter of the present invention, and through which compressed air can be supplied for a pneumatic actuation of the gripper arms or cutting devices not shown, or in which a suction air current can be built up, so as to remove cut yarn ends. For one present invention, it is material to clamp in the region of the lower adapter portion 5 the yarn end extending to a residual wind on a tube 6' by means of the arms 22.1, 22.2 of the lower gripper 22 in the manner shown in FIG. 3.

Once the condition shown in FIG. 3 is reached, the suction device is pivoted sideways together with the upper gripper 37. Thereafter, it is possible to lift the lower adapter portion 5 together with the tubes 6' out of the protective pot 8. The gripper 22 then retracts into the automatic maintenance device B so far that the lower adapter portion 5 with the tubes 6' can be inserted on one of the two mandrels 100, which has moved to a corresponding rotated position.

Figure 4:
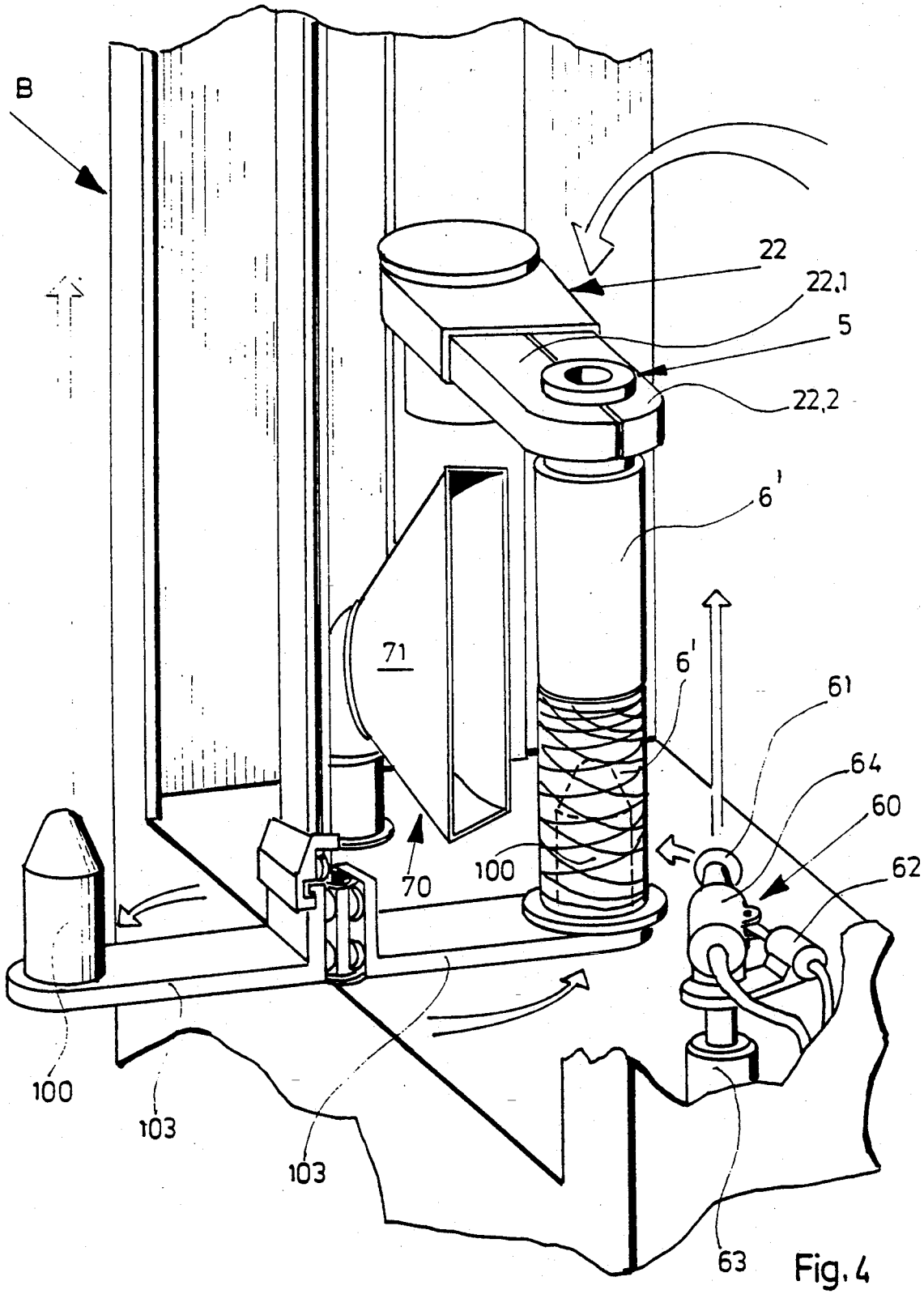
FIG. 4 is a perspective view of portions of servicing and handling elements arranged inside the automatic maintenance device.
Figure 5:
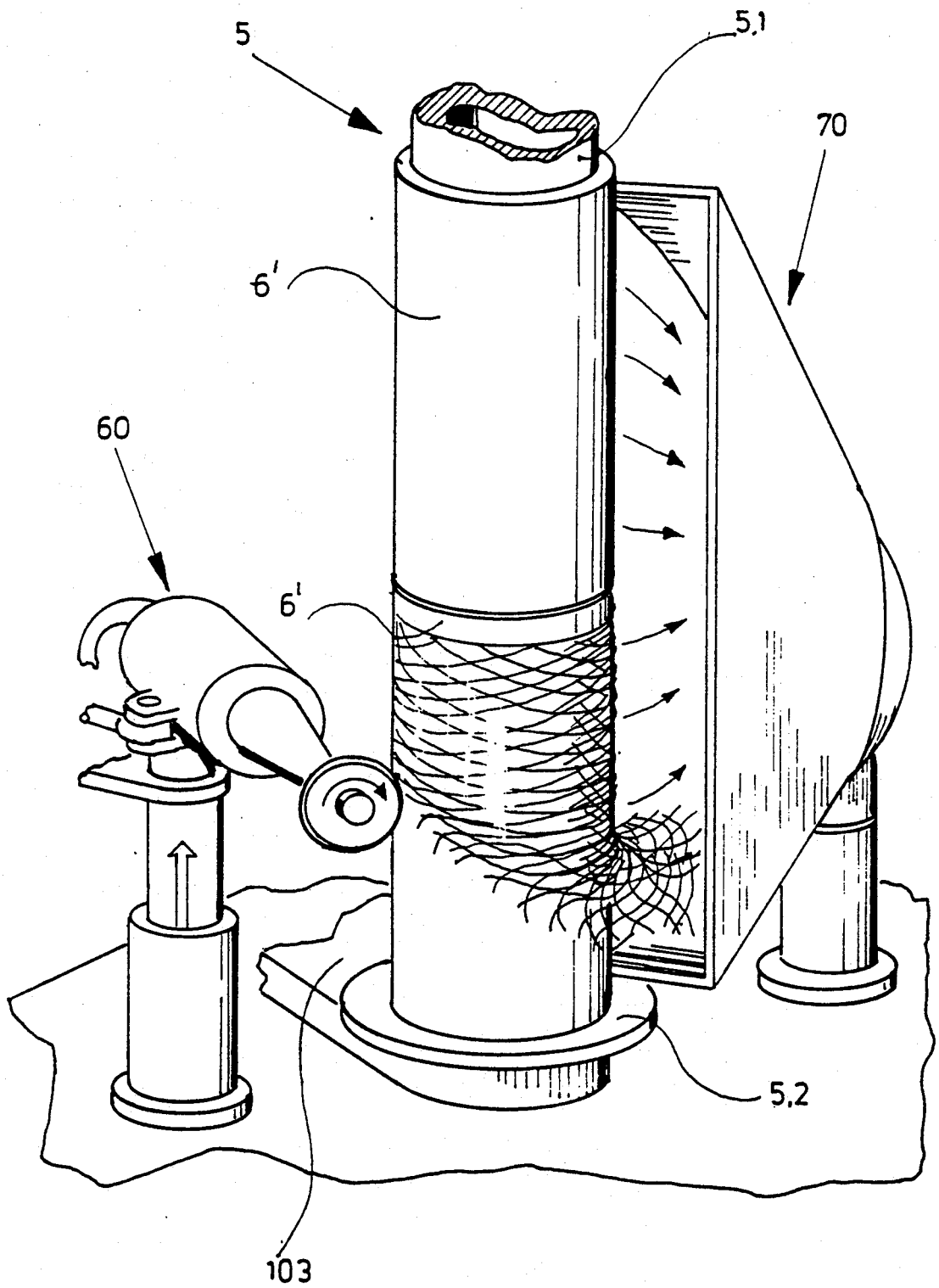
FIG. 5 is a perspective view of cutting and suction devices integrated in the automatic maintenance device during their operation.

Subsequently, as is shown in FIGS. 4 and 5, a cutting device rotatable about a vertical axis is moved with its circular blade 61 against a surface line of the tube 6' which holds a residual yarn wind. The pivotal motion of the cutting device or circular blade 61 is controlled either by sensors, for example, proximity sensors, or by a direct scanning of the tube 6' still carrying a residual yarn wind. In addition, the cutting device 60, 61 is adjustable in vertical direction in such a manner that it is able to move along the entire height of the tubes 6'. The pivotal and lifting motion of the cutting device is preferably effected via hydraulic or pneumatic cylinders 62 or 63 respectively. The rotational drive of the circular blade is effected via a drive means 64, which may be either an electric motor or a pneumatic motor.

The suction device 70, which is arranged inside the automatic maintenance device, comprises an elongate suction pipe connection 71 extending in vertical direction, whose opening corresponds substantially to the entire height of an individual assembly winding tube or two superposed tubes 6'. Preferably, this suction pipe connection 71 is adapted to pivot in horizontal direction in such a manner that it is able to move with its suction opening to a position facing the tubes 6' to be cleaned.

During the cutting of a residual yarn wind on a tube 6' the package or package transport adapter 5 inserted on the mandrel 100 is being held by the gripper 22, while being centered by means of the mandrel 100. Only when the residual yarn wind is completely cut and sucked away through the suction pipe connection 71 connected to a source of vacuum not shown, does the gripper 22 open and release the transport adapter with the now completely stripped tubes 6'.

Thereafter, the cutting device 60 and the suction device 71 are returned to their initial position, so that the mandrel 100 carrying the transport adapter 5 and empty tubes 6' can be moved out of the automatic maintenance device B. Subsequently, the mandrel 100 carrying the unwound unit 5, 6', 6'moves upward, outside the automatic maintenance device B, to deliver this unwound unit to a suspension holder 4.

What is claimed is:

1. In a textile yarn processing machine having a plurality of spindle assemblies mounted in side-by-side relationship longitudinally of said machine and each including an adapter carrying at least one tube and supply package of yarn wound thereon; the improvement of:

a maintenance device including a housing mounted for movement longitudinally along said machine to each of said spindle assemblies and having gripper means mounted in said housing for upward, downward and pivoting horizontal movement to move out of said housing and grip said adapter when the yarn is substantially used therefrom and move said adapter into said housing, mandrel means mounted in said housing for receiving and supporting said adapter moved into said housing by said gripper means, driven cutting means mounted in said housing for upward, downward and pivoting horizontal movement to move into engagement with and along the yarn supply package tube on said adapter on said mandrel means to cut any residual yarn winding thereon, and suction means mounted in said housing adjacent said mandrel means for pivoting horizontal movement to be positioned to remove the cut yarn windings.

2. In a textile yarn processing machine, as set forth in claim 1, in which said suction means includes a pipe having an elongated opening corresponding generally to a longitudinal dimension of the yarn supply package tube.

3. In a textile yarn processing machine, as set forth in claim 1, in which said driven cutting means includes a driven circular blade and fluid operated cylinder means for effecting the upward, downward and pivoting horizontal movement.

4. In a textile yarn processing machine, as set forth in claim 1, in which said gripper means comprises two arms mounted for pivoting movement toward and away from each other so as to tightly enclose a cylindrical portion of said package and transport adapter.

5. In a textile yarn processing machine, as set forth in claim 1, in which said package and transport adapter includes an upper removable portion, and said maintenance device further includes a second gripper means mounted in said housing for upward, downward and pivoting horizontal movement to move out of said housing and grip and remove said upward removable portion of said package and transport adapter from the remaining portion of said package and transport adapter.

6. In a textile yarn processing machine, as set forth in claim 5, in which said second gripper means comprises two movable arms having inwardly directed projections for point-contact engagement with an outer circumferential surface of said upper removable portion of said package and transport adapter.

* * * * *

UNITED STATES PATENT AND TRADEMARK OFFICE

CERTIFICATE OF CORRECTION

PATENT NO. : 5,109,662

DATED : May 5, 1992

INVENTOR(S) : Siegfried Inger

It is certified that error appears in the above-identified patent and that said Letters Patent is hereby corrected as shown below:

ON THE TITLE PAGE

IN THE ABSTRACT:

Line 7, "witha" should be -- with a --.

Column 1, line 18, after "transport" insert -- adapter, and jointly processed, the problem arises that --.

Column 2, line 4, after "means" insert -- is mounted in the housing adjacent the mandrel means --.

Column 2, line 11, "adapted" should be -- adapter --.

Column 3, line 36, "6" should be -- 6' --.

Column 3, line 44, "gripped" should be -- gripper --.

Column 3, line 47, after "is" delete -- .00 --.

Column 3, line 66, after "device" insert -- B, which is adapted to move upward and downward, and to --.

Column 4, line 32, after "head" insert -- and --.

Column 5, line 26, delete "one" and insert -- the --.

UNITED STATES PATENT AND TRADEMARK OFFICE

CERTIFICATE OF CORRECTION

PATENT NO. : 5,109,662

DATED : May 5, 1992

INVENTOR(S) : Siegfried Inger

It is certified that error appears in the above-identified patent and that said Letters Patent is hereby corrected as shown below:

Column 5, line 26, delete "one" and insert --the--.

Signed and Sealed this

Tenth Day of August, 1993

*Attest:*

Michael K. Kirk

MICHAEL K. KIRK

*Attesting Officer*

*Acting Commissioner of Patents and Trademarks*